US007687023B1

(12) United States Patent
Lee

(10) Patent No.: US 7,687,023 B1
(45) Date of Patent: Mar. 30, 2010

(54) TITANIUM CARBIDE ALLOY

(76) Inventor: Robert G. Lee, 4344 SW. Chesapeake Ave., Portland, OR (US) 97239

( * ) Notice: Subject to any disclaimer, the term of this patent is extended or adjusted under 35 U.S.C. 154(b) by 342 days.

(21) Appl. No.: 11/695,588

(22) Filed: Apr. 2, 2007

Related U.S. Application Data

(60) Provisional application No. 60/787,841, filed on Mar. 31, 2006.

(51) Int. Cl.

| | |
|---|---|
| ***C22C 1/05*** | (2006.01) |
| ***C22C 29/02*** | (2006.01) |
| ***B22F 1/00*** | (2006.01) |
| ***B22F 1/02*** | (2006.01) |
| ***C22B 1/14*** | (2006.01) |

(52) U.S. Cl. ..... 419/17; 75/236; 75/252; 75/770

(58) Field of Classification Search ..... 75/228, 75/230, 236, 245, 255, 252, 746, 751, 765, 75/769, 770; 419/1, 5, 6, 10, 14, 17, 30, 419/32, 38, 39, 47, 48–52, 66–69; 428/544–546, 428/448, 551, 552, 568, 615, 617

See application file for complete search history.

(56) References Cited

U.S. PATENT DOCUMENTS

| | | | | |
|---|---|---|---|---|
| 2,751,668 | A * | 6/1956 | Turner, Jr. et al. | 75/236 |
| 2,753,261 | A * | 7/1956 | Goetzel et al. | 419/17 |
| 2,929,126 | A * | 3/1960 | Bollack et al. | 264/647 |
| 3,052,538 | A * | 9/1962 | Jech et al. | 75/238 |
| 3,676,161 | A * | 7/1972 | Yates | 501/87 |
| 3,865,586 | A * | 2/1975 | Volin et al. | 419/15 |
| 4,194,910 | A * | 3/1980 | Mal et al. | 75/236 |
| 4,731,115 | A | 3/1988 | Abkowitz et al. | |
| 4,915,903 | A * | 4/1990 | Brupbacher et al. | 420/129 |
| 4,919,718 | A * | 4/1990 | Tiegs et al. | 75/232 |
| 4,946,643 | A * | 8/1990 | Dunmead et al. | 419/12 |
| 4,987,033 | A | 1/1991 | Abkowitz et al. | |
| 5,015,290 | A * | 5/1991 | Tiegs et al. | 75/232 |
| 5,409,518 | A | 4/1995 | Saito et al. | |
| 5,520,879 | A | 5/1996 | Saito et al. | |
| 6,117,204 | A | 9/2000 | Saito et al. | |
| 6,387,196 | B1 | 5/2002 | Yamaguchi et al. | |
| 6,551,371 | B1 | 4/2003 | Furuta et al. | |
| 6,607,693 | B1 | 8/2003 | Saito et al. | |
| 6,849,230 | B1 | 2/2005 | Feichtinger | |
| 7,354,548 | B2 * | 4/2008 | Liu | 419/10 |

FOREIGN PATENT DOCUMENTS

| | | |
|---|---|---|
| JP | 03-044431 | 2/1991 |

* cited by examiner

*Primary Examiner*—George Wyszomierski
*Assistant Examiner*—Vanessa Velasquez
(74) *Attorney, Agent, or Firm*—Klarquist Sparkman, LLP

(57) ABSTRACT

A composite alloy that contains TiC is made using a green binder system of titanium sponge granules and a liquid phase binder system comprising titanium, nickel, and aluminum. The alloy has a mass of less than 5 grams per cubic centimeter. The alloy may be bonded to a hard substrate to provide an armor tile.

12 Claims, 12 Drawing Sheets

As-Shot

Wafer shot with AR-15, 16 inch barrel, full metal jacket 58 grain standard Nato round.

TiC-Ti is .2015 thick. CP Ti back is .120 thick.

Tic-Ti broken from bullet but not shattered. CP Ti back is cracked but no penetration of by the bullet.

After Partial Disassembly

As-Shot

Wafer shot with AR-15, 16 inch barrel, full metal jacket 68 grain standard Nato round.

TiC-Ti is .2015 thick. CP Ti back is .120 thick.

Tic-Ti broken from bullet but not shattered. CP Ti back is cracked but no penetration of by the bullet.

After Partial Disassembly

Magnification 1.7X 1.7X

Magnification 1.7X 1.7X

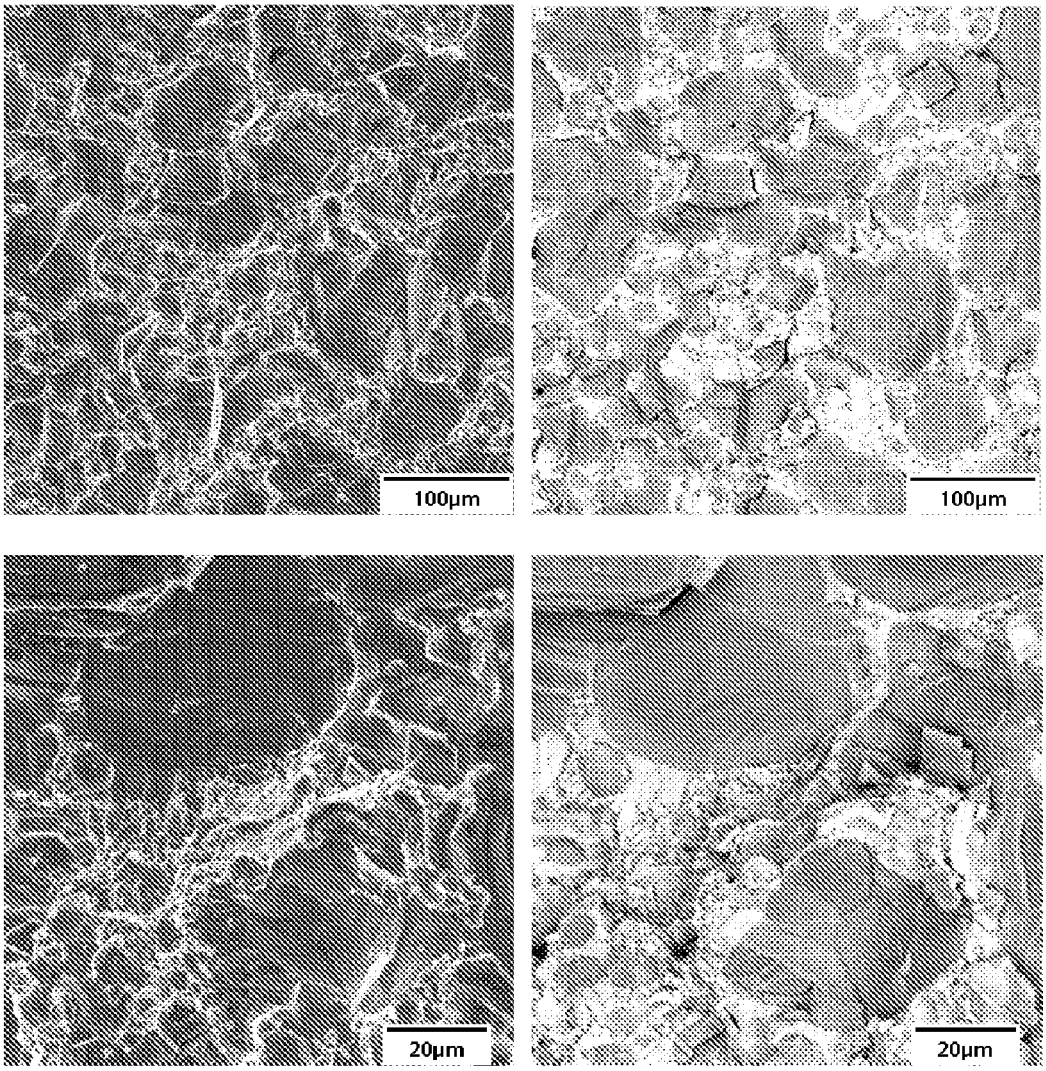
Backscattered electron
FIG. 2
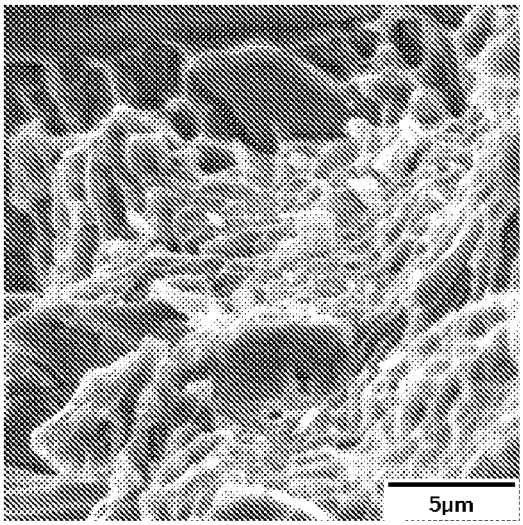
Secondary Electron

Brittle, High Density Fracture

Brittle, Low Density Fracture

High Density Deposit

High Density Deposit

Microhardness data obtained from the metallographic section through the interface. Microhardness test locations and Vickers (HV) hardness data are shown.

TITANIUM CARBIDE ALLOY

CROSS-REFERENCE TO RELATED APPLICATION

This claims the benefit of U.S. Provisional Application No. 60/787,841, filed Mar. 31, 2006, which is incorporated herein in its entirety.

BACKGROUND AND SUMMARY

Frequently very hard TiC powders are "cemented" or liquid phase sintered using binders made of nickel, molybdenum, niobium and tungsten which in combination may total 41% of the weight with the balance 59% lightweight TiC. Nickel with a density of 8.9 g/cc may be as much as 25% of the binder material. All the metals used have high weights, molybdenum 10.22 g/cc, niobium 8.57 g/cc and tungsten 19.3 g/cc, resulting in a density of 6.15 g/cc for the composite TiC alloy. The hardness of the TiC alloy is attractive for armor applications. However, binder systems that use elements that are relatively heavy create a weight disadvantage for certain applications.

To avoid limitations of other systems, it would be good to have a hard TiC based alloy that is lighter in weight than 6.15 grams/cc and/or to have an alloy system that will bond with titanium and ceramics thereby creating composite structures. It would be particularly advantageous to have an alloy that will form bonds to titanium and other materials such as alumina ceramics allowing the production of composite structures offering advantages in attachment methods, weight, ductility and ballistics properties.

The present disclosure relates to alloy systems that contain TiC and are made by using a green binder system of titanium sponge granules or titanium powders and a binder system comprising titanium, nickel, and aluminum provided either as a master alloy or as elemental powders.

Unique features may include substitution of titanium in the liquid phase binder and the use of soft titanium sponge granules as a green binder.

BRIEF DESCRIPTION OF THE DRAWINGS

In the drawings:

FIG. 2 includes electron micrographs of a composite layer fracture surface for the tile of FIG. 1.

DETAILED DESCRIPTION

Figure 1:
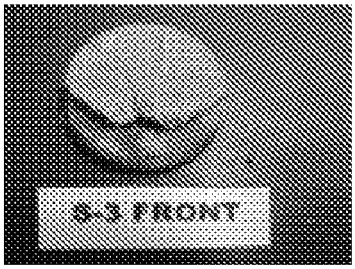
FIG. 1 includes photographs that illustrate a tile comprising a layer of TiC—Ti composite alloy bonded to a substrate layer of titanium.
Figure 1:
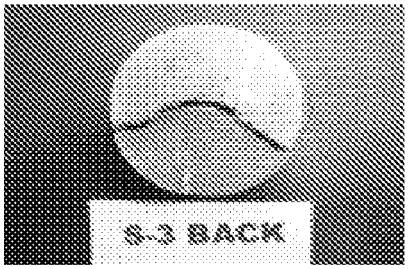
Figure 1:
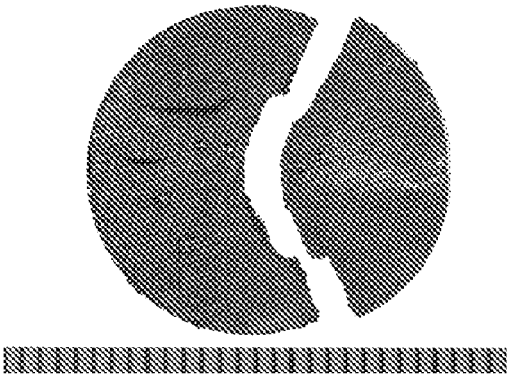
Figure 1:
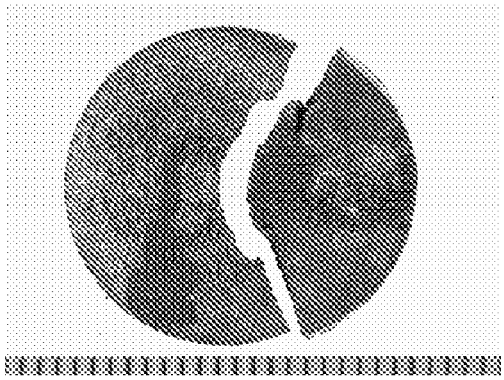
Figure 1:
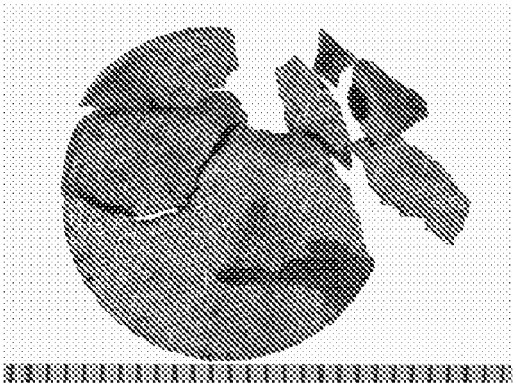
Figure 1:
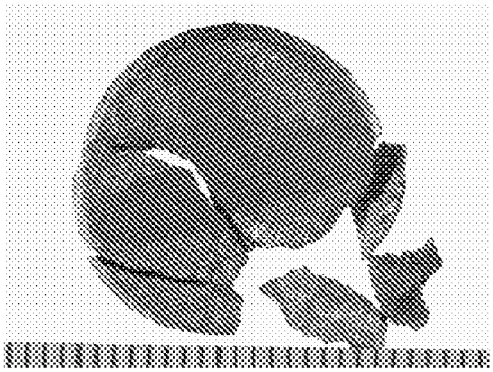

A new composite alloy includes titanium, aluminum, carbon, and nickel, and may include lesser amounts of other elements including iron and silicon.

The composite alloy may be formed from a mixture comprising titanium sponge granules (TSGs), a master alloy containing nickel, titanium, aluminum and iron, and TiC powder in the following amounts:

Titanium sponge granules from 20 wt. % to 54 wt. %,
NiTiAl master alloy from 12.5 wt. % to 25 wt. %, and
TiC from 32 wt. % to 55% wt. %.

A master alloy is a composition made for the purpose of melting and/or bonding with other metals to form alloys. Master alloys are used to overcome the problems of alloying metals of widely differing melting points, or to facilitate closer control over the final composition. Such a master alloy is made by melting or exothermic reaction of the metals making up the composition; and the resulting mixture which is very friable is reduced to the desired particle size by mechanical methods before blending with other components of the product alloy.

For the purposes of this disclosure, titanium sponge granules (TSGs) are defined as irregular shaped particles of sponge fines from titanium metal reduction processes using sodium, magnesium or calcium as the reducing agent to extract the titanium and where the titanium sponge granules have not been melted. For the procedures described herein, best results are achieved using TSGs made with a process using sodium as the reducing agent, although other soft, non-melted titanium sponge granules could be used. TSGs have a low apparent density, below 1.50 g/cc, and a low tap density, specifically a tap density of less than 1.90 g/cc.

"Hard powder" as referred to herein, includes powders, particles and/or granules, such as TiC powder, having yield strengths above 100,000 psi. Hard powders are so hard that a volume of hard powder will not stick together when compacted in a die to form a compact for subsequent processing by the application of heat and/or pressure such as sintering, hot pressing, and hot isostatic pressing, without contamination of the base material or subsequently formed alloy.

The starting materials and alloys described in this disclosure typically will contain small amounts of other elements, sometimes referred to herein as "trace elements," including residuals, impurities, dopants, and the like. Commercially available component materials typically contain small amounts of one or more of O, H, N, Na, Cl, Co, Cr, Cu, Mg, Mn, Mo, Nb, Pd, Sb, Sn, Ta, V, W, Zr, and S. The exact amounts of such elements in starting materials typically is not known because commercially available component materials are not routinely assayed for all possible included elements. Therefore the main elements, i.e. titanium and nickel, are normally established by subtracting the elements analyzed for from 100%. Industry specifications for titanium alloys vary widely in the number of elements analyzed for. Best results are achieved if such other elements do not constitute more than 1% of a product alloy system.

The titanium sponge granules serve to bind together the very hard TiC powders and the very hard NiTiAl master alloy so that the blend can be compacted by normal powder metal techniques in closed die mechanical and hydraulic presses to form green compacts. In this way, relatively high production rates can be achieved without scoring of a die with the very hard TiC.

By one method, NiTiAl master alloy is combined with other materials to form a new alloy.

The master alloy comprises:

24 wt. % to 28 wt. % titanium,
7 wt. % to 12 wt. % aluminum,
0 wt. % to 0.1 wt. % carbon,
0 wt. % to 4.5 wt. % iron,
0 wt. % to 4 wt. % silicon,
with the balance being nickel and trace elements.

This master alloy is friable and can be milled to fine powder of various sizes.

To complete formation of the new alloy, the mixture is compacted at forces ranging from 40,000 psi to 120,000 psi to form a green compact. The pressed green compact is sintered in a vacuum furnace at temperatures from 900° C. to 1400° C. depending on the ratios of nickel, TiC and TSG in the final alloy. The compact may also be processed by hot isostatic pressing (HIP) either before or after vacuum sintering.

Good results are achieved with powder sizes of −40 US Standard mesh and down. However, it is best to use finer mesh sizes such as −325 mesh, especially for the NiTiAl master alloy and the TiC. The size of each powder used can be varied to produce different green compacts and sintered structures depending on the desired properties, pressing and sintering parameters.

The composition of the resulting alloy will vary within ranges depending on the variations in the input materials and the allowable variations in the elements in the master alloy. According to the tests shown in Table I, the composition will fall with the following ranges where the ingredient materials are adjusted to produce a final composition that is equal to 100% within the limitations shown below.

71 wt. % to 84 wt. % titanium,
6.5 wt. % to 16 wt. % nickel,
1 wt. % to 4 wt. % aluminum,
0 wt. % to 1 wt. % iron,
0 wt. % to 1 wt. % silicon,
6 wt % to 11 wt % carbon
0 wt. % to 1.5 wt. % other elements.

The density of the composite alloy will vary depending on the ratios of the input materials and can be as high as 5.0 grams/cc. Measured densities of experimental alloys have ranged from 3.63 grams/cc to 4.42 grams/cc.

The degree to which the alloy system becomes liquid during the sintering cycle can be varied by changes in the ratios of each ingredient and the sintering time and temperature. Some of these conditions are shown in Table I where increasing the TiC and decreasing the NiTiAl master alloy resulted in less melting, and no melting. Other experiments and tests have demonstrated those conditions.

In this instance, the objective is to produce a final "net shape part" which requires control of the liquid phase in order to retain the desired shape and dimensions.

The tests in columns 2 and 3 numbered from the left of Table I are considered failures with regard to the powder metallurgy method described above, because the green bodies at least partially melted and did not keep their shape. Useful alloy compositions may, however, also be made by melting with the molten metal poured into a solid mold such as an ingot or a mold to produce a specific final or preform configuration such as would be done by investment casting or permanent mold casting technology.

Elemental Powders

Elemental powders may be substituted for all or a portion of the NiTiAl master alloy in the procedure discussed above, but use of the master alloy typically is superior.

The composition of the resulting composite will vary depending on the ratio of each input material with the main ingredients consisting of the following ranges where the ingredient materials are adjusted to equal 100% which produces a final composition that is equal to 100% within the limitations show.

71 wt. % to 84 wt. % titanium,
6.5 wt. % to 16 wt. % nickel,
1 wt. % to 4 wt. % aluminum,
0 wt. % to 1 wt. % iron,
0 wt. % to 1 wt. % silicon,
6 wt. % to 11 wt. % carbon, and
0 wt. % to 1.5 wt. % other elements.

Results

Table I is a summary of the results of tests made on various alloy systems as described herein.

From the data in Table I the actual wt % of each element can be calculated which will depend on the actual chemistry of the NiTiAl master alloy and ratio of input materials with the total chemistry being equal to 100%.

TABLE I

Titanium Carbide Alloy

| Sample ID | May 3, 2004 | 503403030 | NiTi722 | T-2-825 | T-3-908 | Ti-4-922 | Ti-5-923 | T-7 | S-3 |
|---|---|---|---|---|---|---|---|---|---|
| Type | Slug | Slug | Sandwich | Sandwich | Sandwich | Sandwich | Sandwich | Tile | |
| Input materials | | | | | | | | | |
| TSG | 60.0% | 30.0% | 20.0% | 32.5% | 54.0% | 38.0% | 32.5% | 38.0% | 38.0% |
| NiTiAl master alloy | 40.0% | 40.0% | 25.0% | 12.5% | 14.0% | 14.0% | 12.5% | 14.0% | 14.0% |
| TiC | 0.0% | 30.0% | 55.0% | 55.0% | 32.0% | 48.0% | 55.0% | 48.0% | 48.0% |
| Total blend | 100% | 100% | 100% | 100% | 100% | 100% | 100% | 100% | 100% |
| Composition of composite | | | | | | | | | |
| Ni percent of total | 25% | 25% | 16% | 8% | 9% | 9% | 8% | 9% | 9% |
| Al percent of total | 4% | 4% | 2% | 1% | 1% | 1% | 1% | 1% | 1% |
| Fe percent of total | 0% | 0% | 0% | 0% | 0% | 0% | 0% | 0% | 0% |
| C percent of total | | 6% | 11% | 11% | 6% | 9% | 11% | 9% | 9% |
| Ti percent of total | 71% | 65% | 71% | 80% | 84% | 81% | 80% | 81% | 81% |

TABLE I-continued

| Titanium Carbide Alloy | | | | | | | | | |
|---|---|---|---|---|---|---|---|---|---|
| Total listed | 100% | 100% | 100% | 100% | 100% | 100% | 100% | 100% | 100% |
| Sinter | | | | | | | | | |
| Time-hours | 0.5 | 0.5 | 0.5 | 0.5 | 1.5 | 1.5 | 1.5 | 1.5 | 1.5 |
| Temp-degree F. | 2200 | 2200 | 2200 | 2200 | 2200 | 2200 | 2200 | 2200 | 2200 |
| Hardness | | | | | | | | | |
| Top-Rockwell C scale | Melt | Less | No Melt | 76 | 82 | | | | |
| Bottom-Rockwell c scale | Splatter | Melt | | 73 | 86 | | | | |
| Vickers Average | | Ta | 1711 | 1950 | 979 | 1278 | 1230 | 1300 | Shot |
| Vickers Ave ex high | | | 1054 | 1172 | 979 | 1191 | 1123 | 1210 | |
| Vickers Ave ex high & low | | | | | | 1213 | 1174 | 1264 | |
| No of Vickers over 2400 | | | 3 | 4 | 0 | 0 | 0 | 0 | |
| Notes | | | | | | | | | |

503403030 indicates that melting caused by the reaction of Ni and Ti is reduced by the additions of TiC
T-2-825 Has the highest number of hard spots. Appears to be smaller grain and more melt.
T-3-908 has no hard spots, ie above 2400 V. Has lower average vickers. Perhaps the longer sinter time is dissolving the TiC.
Vickers readings taken at .050 intervals with 10 or more in each sample
The absence of very hard spots (TiC) indicates that the binder system is wetting and forming a bond with the TiC, confirmed by SEM examination.

| Ingredients compositions | TSG | TiC | NiTiAl | NiTiAl (Low Ti) | NiTiAl (High Ti) | NiTiAl (Mid Ti) |
|---|---|---|---|---|---|---|
| Titanium | 100% | 80.58% | 27.39% | 24% | 28% | 24.7% |
| Carbon | | 19.42% | | | | |
| Nickel | | | 62.59% | 69% | 52% | 60.0% |
| Iron (Fe) | | | 0.06% | 0% | 4% | 3.6% |
| Aluminum | | | 9.94% | 7% | 12% | 9.3% |
| Silicon | | | | 0% | 4% | 2.5% |
| Total | 100% | 100% | 100% | 100% | 100% | 100% |

The TiC—Ti alloy may be used by itself depending on the application. Composite structures with layers of titanium and TiC—Ti alloy have been demonstrated as workable as shown in Table I. These composite structures can be produced with single or multiple layers of many different thicknesses and combinations that will produce different densities and properties. Such composite structures can be made either by placing loose titanium powders and TiC—Ti alloy powders in a die in the desired thickness ratios, followed by pressing and sintering as described herein. Or preformed wafers of one or each of the components could be used to form the composite structure. It is logical to assume that well known alloys of titanium can be used with the TiC—Ti alloy to form such composite structures to meet special application needs.

FIG. 1 is a photograph that illustrates a potential application for armor tile. A wafer about 0.2 inch thick of TiC—Ti alloy (S-3 of Table I) was pressed and sintered onto an about 0.1 inch thick substrate layer of titanium sponge granules.

The resulting two-layer wafer was shot with an AR-15, 16 inch barrel, full metal jacket, standard NATO round. The TiC—Ti alloy was cracked and broken loose from the substrate but the bullet did not penetrate the substrate as shown in the photo of the back side of the two-layer wafer. The same type of bullet fully penetrated a 0.25 inch thick mild steel target.

The tile shown in FIG. 1 was found to have the following properties.

1) Fracture of the titanium carbide composite occurred in a mixed ductile/brittle manner:
   i. The titanium carbide phase fractured along coarse brittle facets.
   ii. A low nickel content titanium-nickel alloy phase fractured in a ductile manner.
   iii. A higher nickel content titanium-nickel alloy phase fractured along finer brittle facets.
2) The tortuous crack path and frequent changes in direction as the crack propagated through interfaces suggests substantial energy absorption and substantial resistance to cracking relative to other hard materials such as ceramics.
3) Fracture occurred through both the titanium carbide aggregate phase and the two titanium-nickel alloy matrix phases. Fracture did not preferentially follow phase boundaries.
4) Fracture through the titanium carbide phase was heavily branched. Many of the branched cracks terminated at the carbide to matrix interface. These features suggest substantial energy absorption during crack propagation.
5) Separation between the CP titanium layer and the titanium carbide composite layer occurred within the titanium carbide composite layer.
6) Fracture of the CP titanium layer occurred in a ductile manner.
7) Lead and copper particles present on entry and exit side areas of the titanium carbide fracture surface indicates that the bullet penetrated this layer. Extensive deposition of lead occurred on the interface side of the CP titanium layer.

FIG. 2 shows secondary electron and backscattered electron images of the composite layer fracture surface. The three secondary electron images indicate a mixed ductile/brittle fracture. Comparison of the backscattered electron and secondary electron images indicates brittle faceted fracture of a low density aggregate phase, and ductile fracture of a higher density matrix phase.

Figure 3:
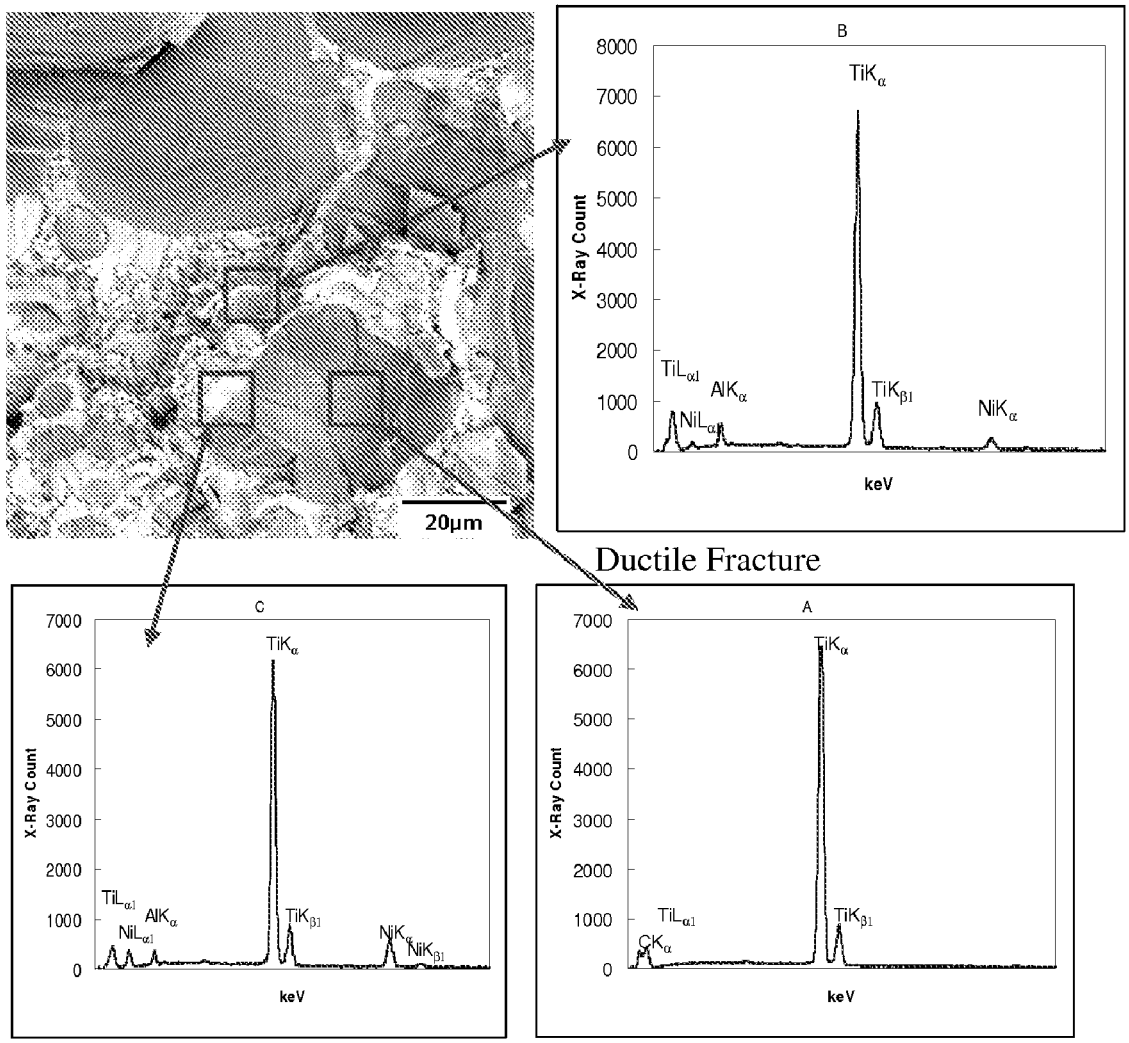
FIG. 3 includes graphs showing x-ray spectra for the tile of FIG. 1.

FIG. 3 shows backscattered electron image and energy dispersive x-ray spectra acquired from ductile and brittle areas of the composite fracture surface. The results suggest a two phase matrix consisting of a lower nickel, nickel-titanium alloy and a higher nickel, nickel-titanium alloy. Ductile fracture appears to be confined to the lower nickel matrix phase.

Figure 4:
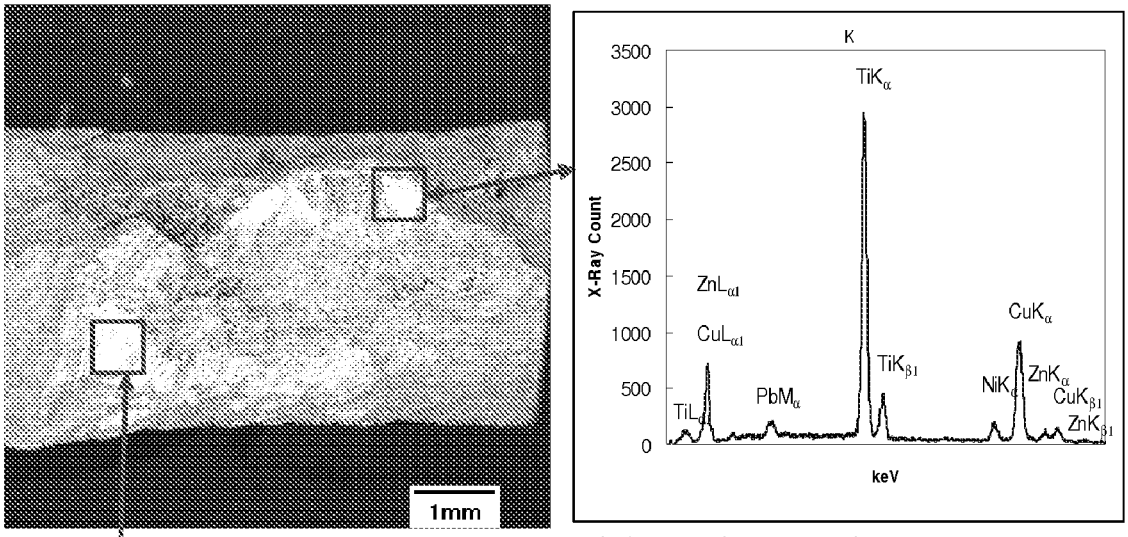
FIG. 4 includes an electron micrograph and graphs showing x-ray spectra for the tile of FIG. 1.
Figure 4:
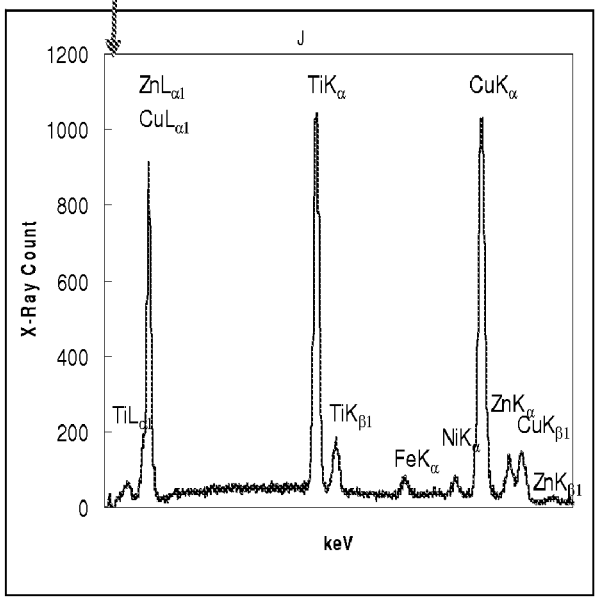

FIG. 4 shows backscattered electron image and energy dispersive x-ray spectra acquired from the fracture surface near the impact site. Copper and zinc were detected on both entry (top) and exit sides of the fracture in the titanium carbide composite layer.

Figure 5:
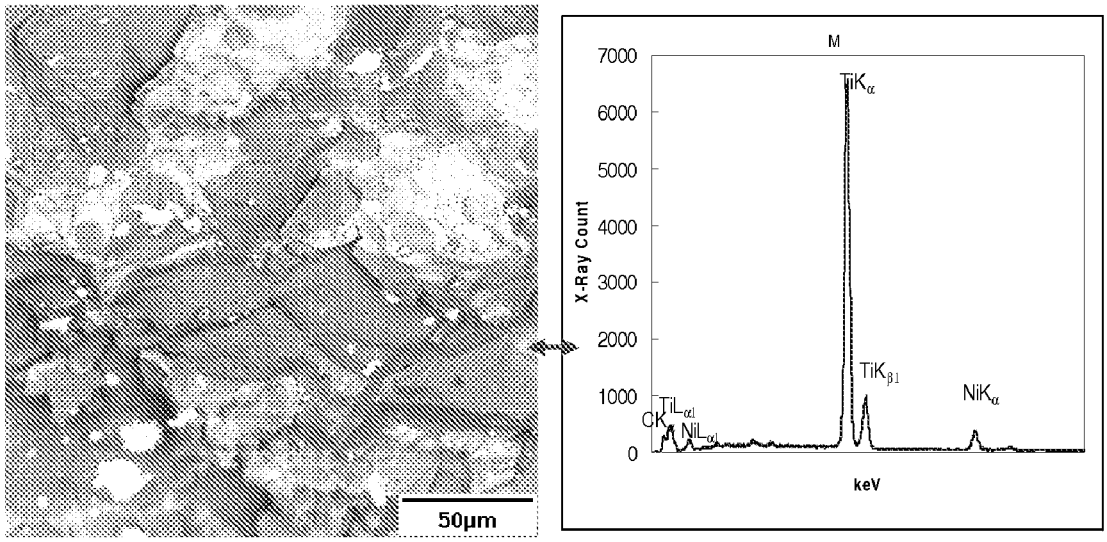
FIG. 5 includes an electron micrograph and a graph showing x-ray spectra for the tile of FIG. 1.

FIG. 5 shows backscattered electron image and energy dispersive x-ray spectra acquired from the failed interface on the composite side. The two-phase structure and presence of nickel indicates failure within the titanium carbide composite rather than at the CP titanium to composite interface.

Figure 6:
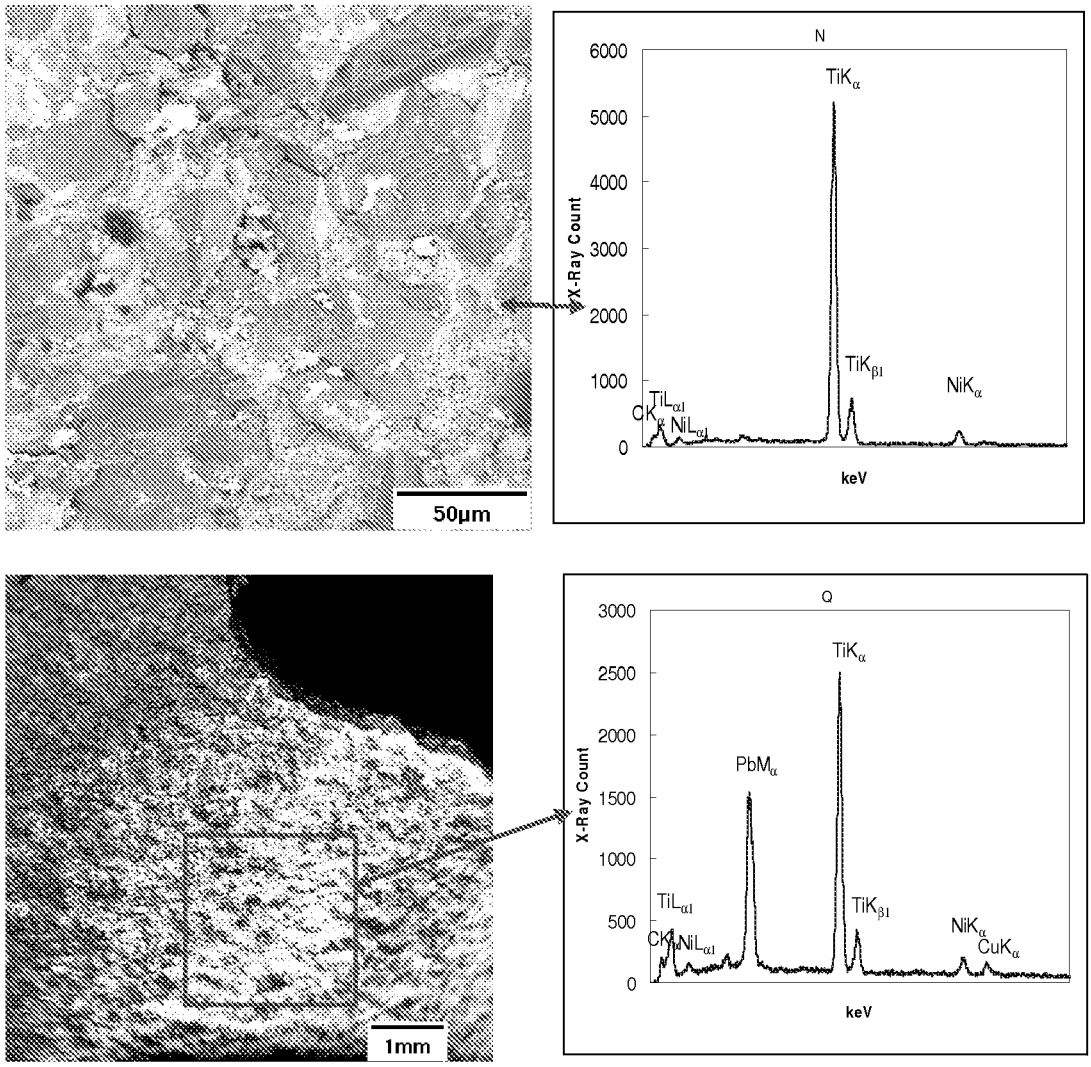
FIG. 6 includes electron micrographs and graphs showing x-ray spectra for the tile of FIG. 1.

FIG. 6 shows backscattered electron image and energy dispersive x-ray spectra acquired from the titanium side of the failed interface. The two-phase structure and presence of nickel indicates fracture through the titanium carbide composite rather than along the CP titanium to composite. Detection of substantial lead on the CP titanium side of the interface indicates substantial destruction of the bullet.

Figure 7:
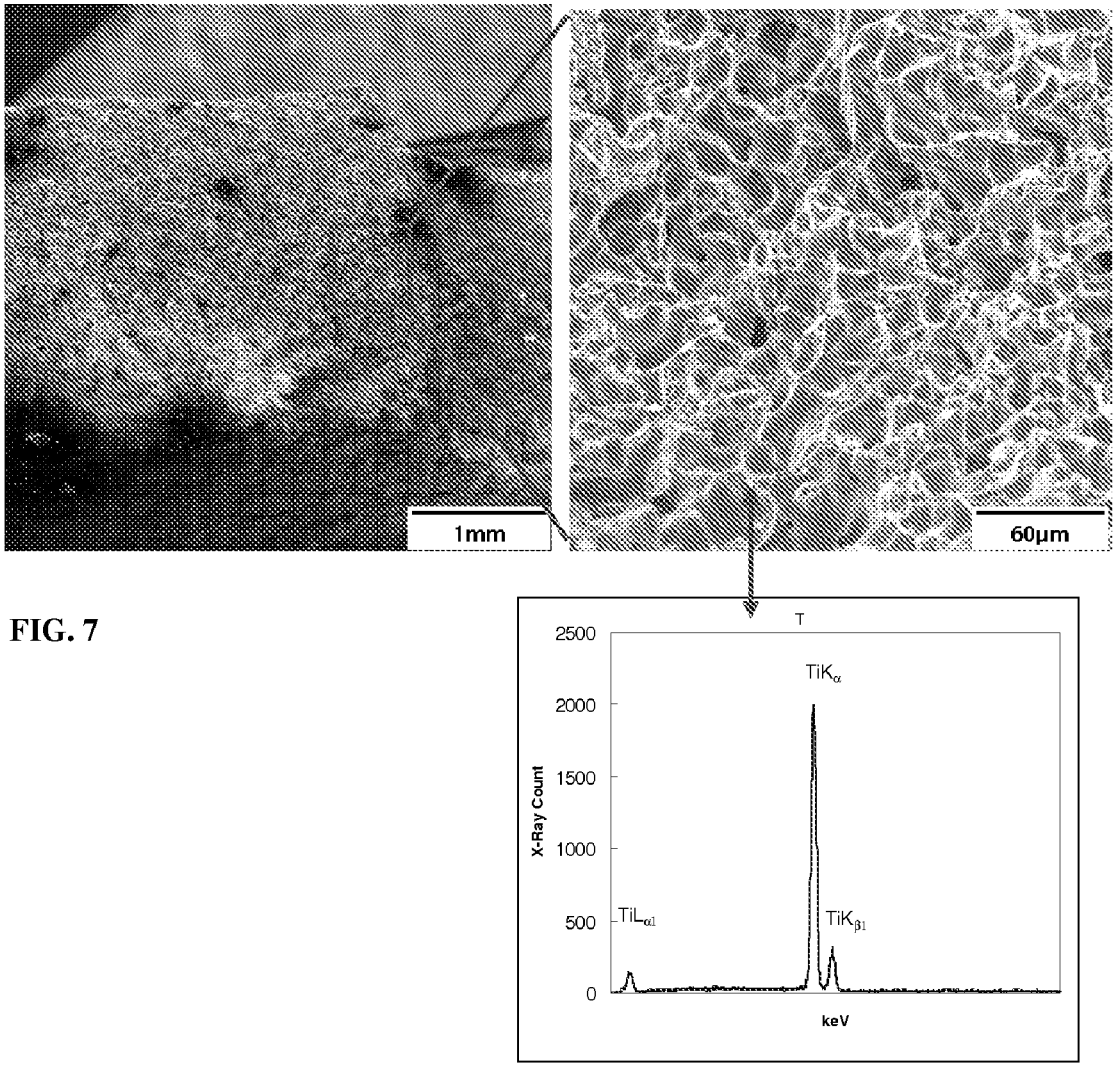
FIG. 7 includes electron micrographs and a graph showing x-ray spectra for the tile of FIG. 1.

FIG. 7 shows backscattered electron image and an energy dispersive x-ray spectra acquired from the fracture in the CP titanium layer. Fracture occurred in a ductile manner.

Figure 8:
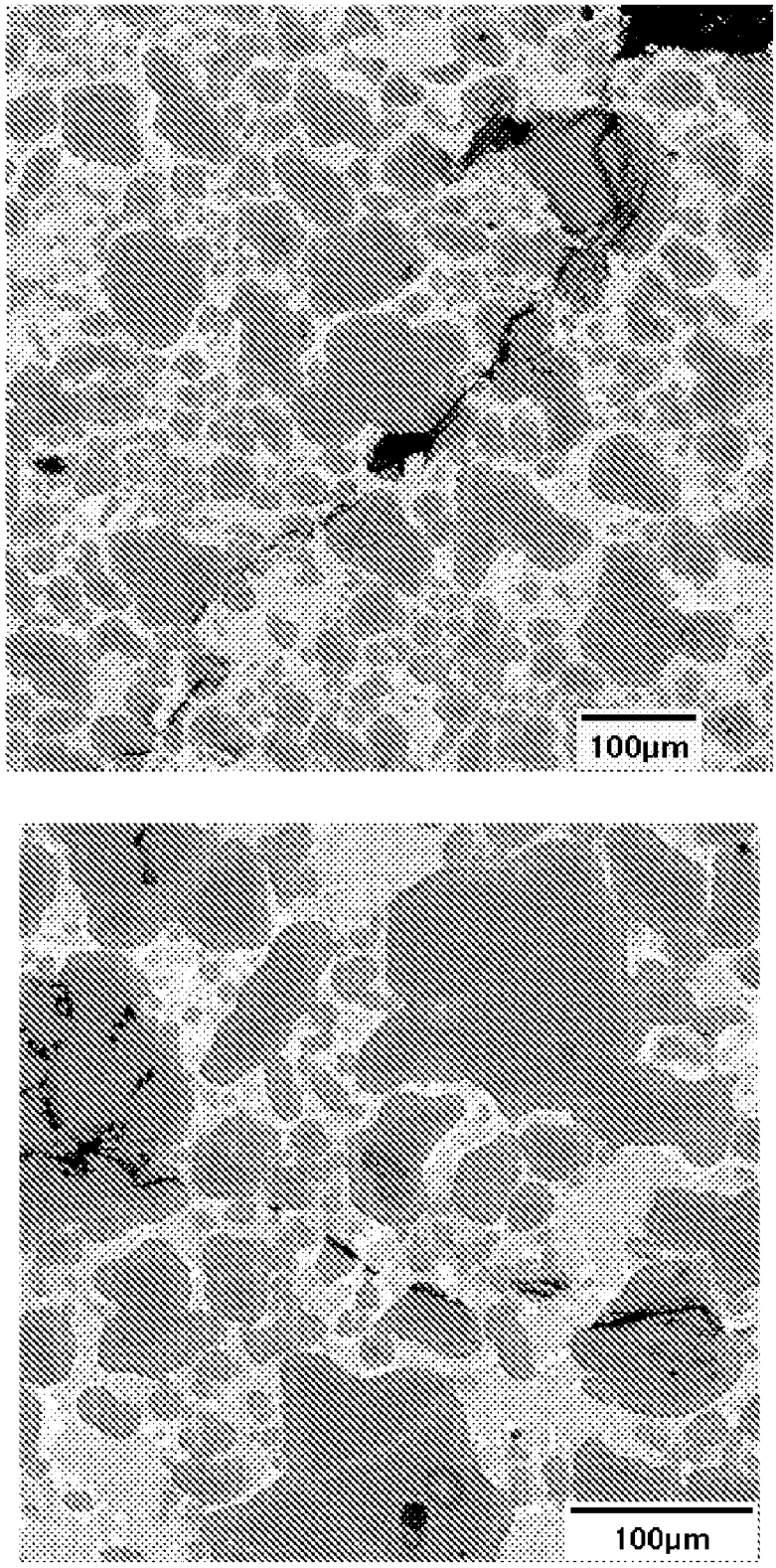
FIG. 8 is an electron micrograph for the tile of FIG. 1.

FIG. 8 shows backscattered electron images of a metallographic section through secondary cracking through the titanium carbide composite layer. The composite consists of a low density aggregate phase (titanium carbide) and a two phase (white and light grey) matrix. The crack tip (lower photo) terminated at an area of discontinuous cracking in the titanium carbide phase only.

Figure 9:
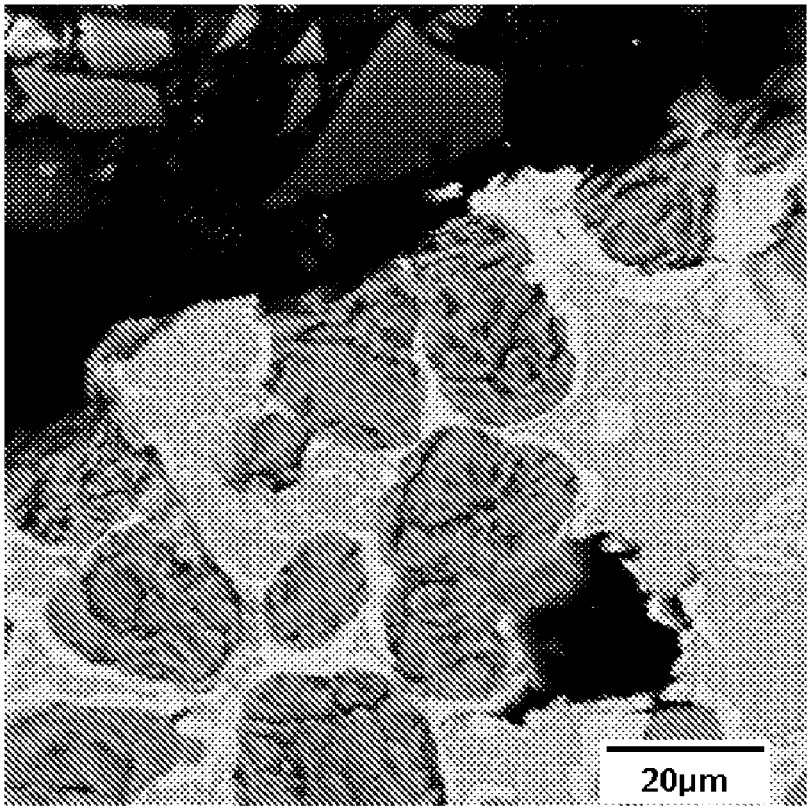
FIG. 9 is an electron micrograph for the tile of FIG. 1.

FIG. 9 shows backscattered electron image of a metallographic section through the primary fracture through the titanium carbide composite layer. Cracking extended through all three phases. Cracking was not confined to a single phase or to the boundaries between the phases.

Figure 10:
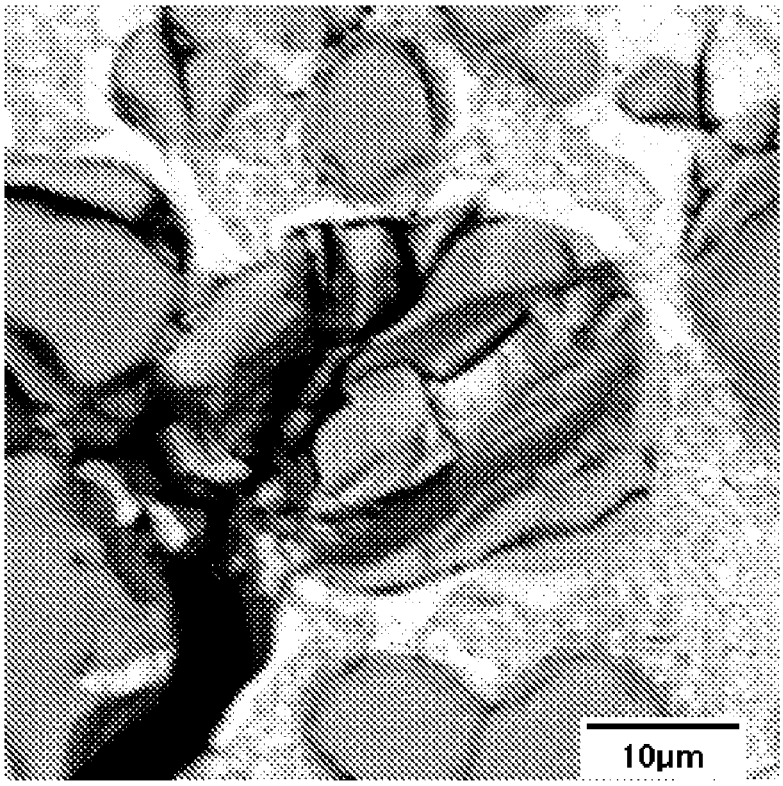
FIG. 10 includes electron micrographs for the tile of FIG. 1.

FIG. 10 shows backscattered electron image of a metallographic section through a secondary crack through the titanium carbide composite layer. Cracking within the carbide phase is highly branched. Many of the cracks appear to terminate at the carbide to matrix boundary. The creating of multiple branched cracks and crack termination at phase boundaries would predictably absorb energy. The apparent fracture mechanism (crack branching in the carbide phase and crack termination at the phase boundaries) may account for the reported good ballistic properties.

Figure 11:
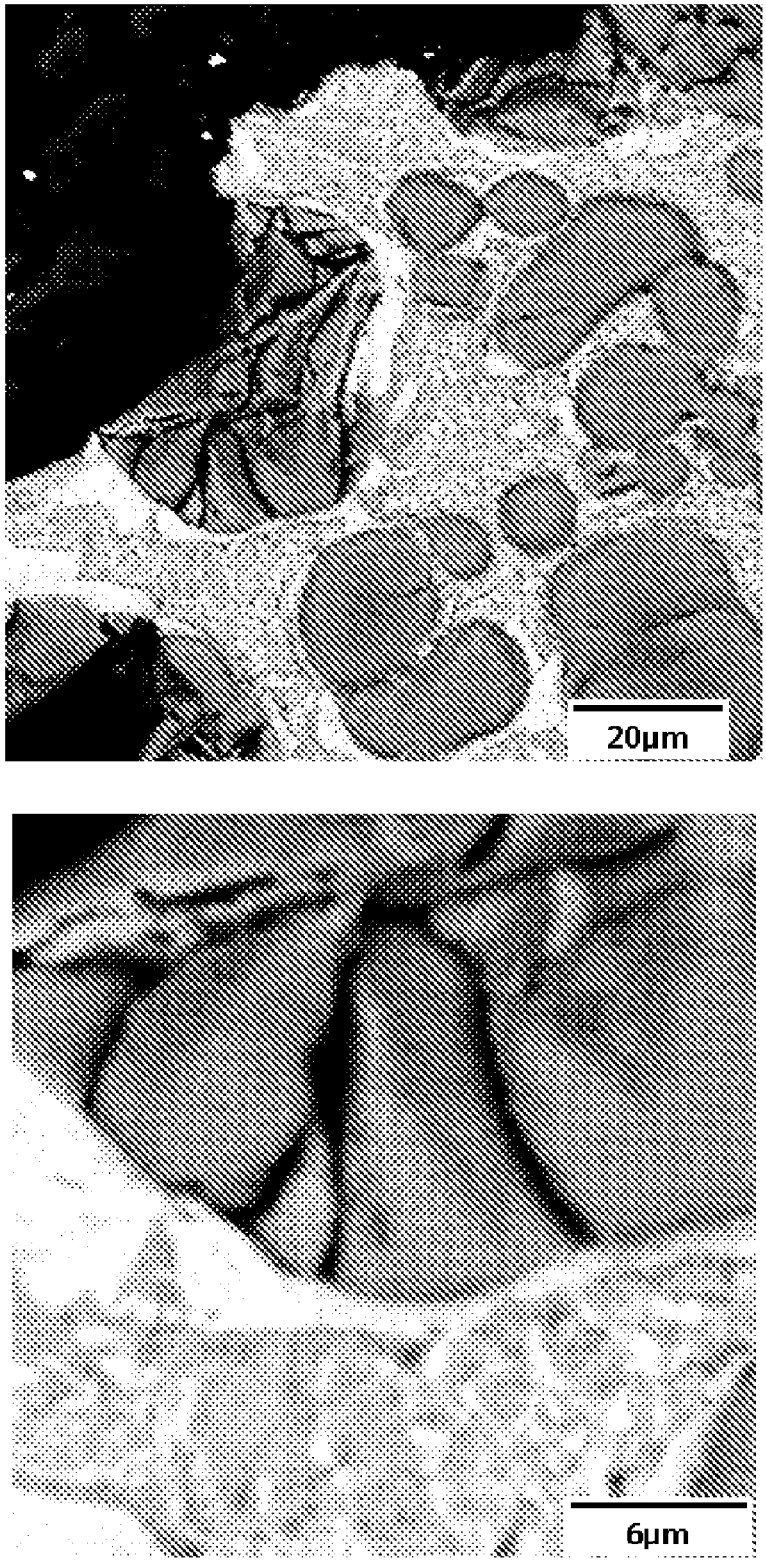
FIG. 11 includes electron micrographs for the tile of FIG. 1.

FIG. 11 shows additional backscattered electron images of a metallographic section through the primary fracture through the titanium carbide composite layer. Branched cracking within the titanium carbide phase and crack termination at the carbide to matrix phase boundary is apparent.

Figure 12:
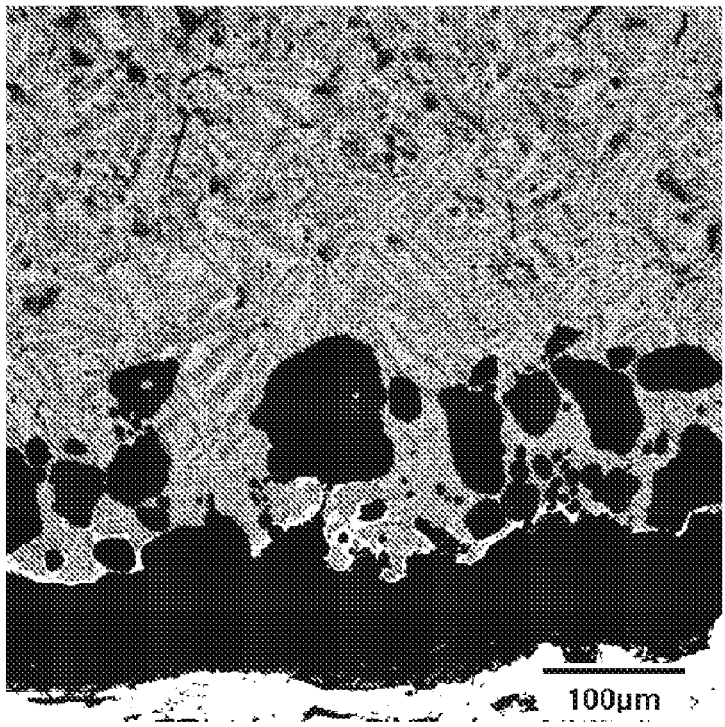
FIG. 12 is an electron micrograph for the tile of FIG. 1.

FIG. 12 shows backscattered electron image of a metallographic section through the CP titanium layer at the separation between the CP titanium and titanium carbide composite layers. Separation occurred in the titanium carbide composite layer, as evidenced by the adhering composite material to the CP titanium.

Figure 13:
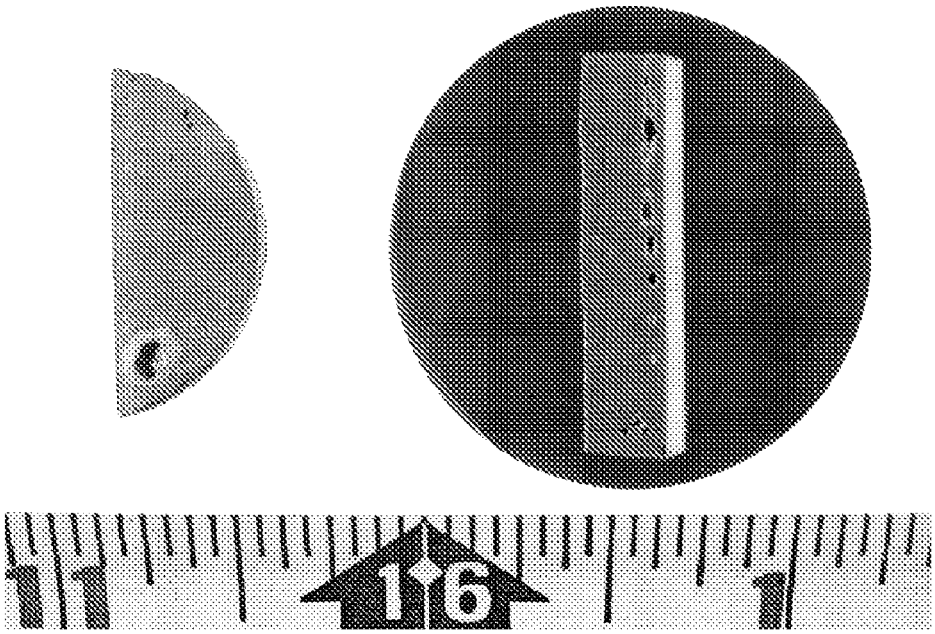
FIG. 13 includes photographs that illustrate a tile comprising a layer of TiC—Ti composite alloy bonded to a substrate layer of alumina ceramic.

Armor tiles may also be made by adhering the TiC—Ti alloy to other substrate materials such as ceramics, including those made from alumina, boron carbide and silicon carbide by sintering the TiC—Ti alloy onto the ceramic material. One example showing good results is shown in FIG. 13. The TiC—Ti alloy was sintered in an alumina ceramic boat, CoorsTek® Catalog No. CR 32 65578. The TiC—Ti wafer was bonded to the ceramic boat and could not be removed without breaking the ceramic boat.

Results indicate diffusion of aluminum from the ceramic to the alloy. The diffusion suggests a chemical, perhaps ionic, rather than a simple mechanical bond. It is a logical extension to assume that similar bonds may be formed with ceramics substrates containing boron and silicon.

Figure 14:
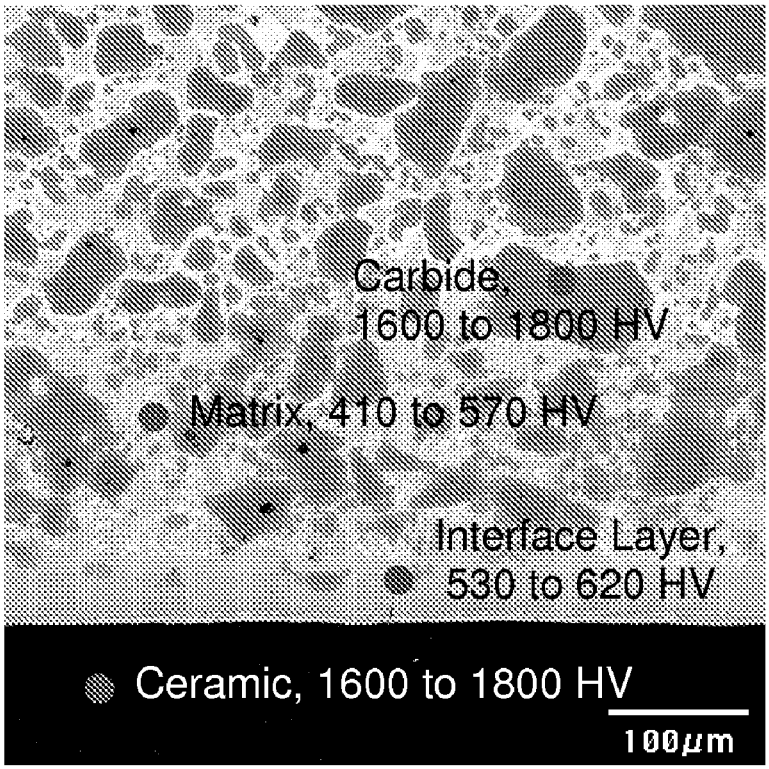
FIG. 14 is an electron micrograph for the tile of FIG. 13 showing microhardness data.

Limited Vickers microhardness data appears in FIG. 14 for the TiC—Ti/ceramic composite of FIG. 13. Some interface layers at the ceramic to metal bond were too thin to entirely contain a Vickers indentation. As a result, the hardness of these layers could not be measured. The hardness of one of the interface layers is moderately higher than that of the matrix phase.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the accompanying claims. For example although specific examples of armor tiles are described herein, it should be appreciated that certain properties of an armor tile, notably size and thickness, will be dictated by the nature of the threat, what areal density is to be achieved, weight, cost, and other system requirements.

And more generally, described herein is a method for forming a reduced density alloy system wherein titanium, aluminum, or a mixture thereof is substituted for at least a portion of one or more of the heavy elements nickel, molybdenum, niobium and tungsten of a known alloy system for cementing carbide powder, such as TiC or WC powder, with the titanium, aluminum, or mixture thereof being substituted in an amount sufficient to reduce the density of the resulting alloy system containing cemented carbide to not more than 5.0 g/cc.

Also more generally described herein is a method for forming an alloy system suitable for bonding to a substrate wherein titanium, aluminum, or a mixture thereof is substituted for at least a portion of one or more of the heavy elements nickel, molybdenum, niobium and tungsten of a known alloy system for cementing carbide powder, such as TiC or WC powder, with the titanium, aluminum, or mixture thereof being substituted in an amount sufficient that components of the resulting alloy system containing cemented carbide better can bond to titanium structures and ceramic structures by sintering.

What is claimed:

1. A method of making an alloy, the method comprising:

forming a mixture comprising 12.5 wt. % to 25 wt. % of a NiTiAl master alloy powder comprising 24 wt. % to 28 wt. % titanium, 7 wt. % to 12 wt. % aluminum, 0 wt. % to 0.10 wt. % carbon, 0 wt. % to 4.5 wt. % iron, 0 wt. % to 4 wt. % silicon, with the balance being nickel and trace elements, 32 wt. % to 55 wt. % of TiC powder, with the balance being titanium sponge granules;

compacting the mixture to form a green compact; and sintering the compact.

2. The method of claim 1 wherein the TiC and master alloy powders are not greater than −40 U.S. Standard mesh sieve size.

3. The method of claim 1 wherein the compacting is conducted at forces ranging from 40,000 psi to 120,000 psi.

4. The method of claim 1 wherein the sintering temperature ranges from 900° C. to 1400° C. and the time at temperature ranges from 1 minute to 8 hours.

5. The method of claim 1 wherein the resulting alloy has the following characteristics:

average hardness as measured by Vickers indenters of not less than 1000, with the lowest reading not less than 660 Vickers;

density not more than 5.0 g/cc; and ductility and fracture toughness exhibited by multiple ductile and brittle, branched, tortuous, energy absorbing crack paths with measurable deformation.

6. The method of claim 5 wherein the resulting alloy has a ductility of at least 0.5% elongation.

7. A method for forming a green compact, the method comprising:

providing a mixture comprising (a) 12.5 wt. % to 25 wt. % of a powder comprising
24 wt. % to 28 wt. % titanium,
7 wt. % to 12 wt. % aluminum,
0 wt. % to 0.10 wt. % carbon,
0 wt. % to 4.5 wt. % iron,
0 wt. % to 4 wt. % silicon,
with the balance being nickel and trace elements, (b) 32 wt. % to 55 wt. % of TiC powder, and (c) titanium sponge granules in an amount sufficient to impart green strength to a green compact formed from the mixture; and compacting the mixture to form a green compact.

8. The method of claim 7 wherein the powders and granules are not greater than −40 U.S. Standard mesh sieve size.

9. The method of claim 7 wherein the compacting is conducted at forces ranging from 40,000 psi to 120,000 psi.

10. A mixture of two types of materials to be used in the production of a green compact for sintering comprising:

(a) 12.5 wt. % to 25 wt. % of a powder comprising
24 wt. % to 28 wt. % titanium,
7 wt. % to 12 wt. % aluminum,
0 wt. % to 0.10 wt. % carbon,
0 wt. % to 4.5 wt. % iron,
0 wt. % to 4 wt. % silicon,
with the balance being nickel and trace elements, (b) 32 wt. % to 55 wt. % of TiC powder, and (c) titanium sponge granules in an amount sufficient to impart sufficient green strength to the compact to allow subsequent handling and processing of the compact.

11. A green compact comprising:

(a) 12.5 wt. % to 25 wt. % of a powder comprising
24 wt. % to 28 wt. % titanium,
7 wt. % to 12 wt. % aluminum,
0 wt. % to 0.10 wt. % carbon,
0 wt. % to 4.5 wt. % iron,
0 wt. % to 4 wt. % silicon,
with the balance being nickel and trace elements, (b) 32 wt. % to 55 wt. % of TiC powder, and (c) titanium sponge granules in an amount sufficient to impart sufficient green strength to the green compact.

12. A method for forming a composite alloy, the method comprising sintering the green compact of claim 11 at 900° C. to 1400° C. for 1 minute to 8 hours.

* * * * *

UNITED STATES PATENT AND TRADEMARK OFFICE

CERTIFICATE OF CORRECTION

PATENT NO. : 7,687,023 B1
APPLICATION NO. : 11/695588
DATED : March 30, 2010
INVENTOR(S) : Robert G. Lee It is certified that error appears in the above-identified patent and that said Letters Patent is hereby corrected as shown below:

In Claim 10 (Column 10, line 1), "A mixture of two types of materials" should read --A mixture of materials--.

Signed and Sealed this

Twenty-second Day of June, 2010

David J. Kappos

David J. Kappos
*Director of the United States Patent and Trademark Office*